US006126040A

United States Patent [19]

Hippensteel

[11] Patent Number: 6,126,040

[45] Date of Patent: Oct. 3, 2000

[54] ATTACK-DETERRENT APPARATUS HAVING FINGER RING, CANISTER AND REPELLENT

[75] Inventor: Joseph B. Hippensteel, 1596 Belle Isle Rd., NE., Atlanta, Ga. 30329

[73] Assignee: Joseph B. Hippensteel, Atlanta, Ga.

[21] Appl. No.: 09/094,155

[22] Filed: Jun. 9, 1998

[51] Int. Cl.[7] ..... B67D 83/14

[52] U.S. Cl. ..... 222/78; 222/175; 222/402.1; 222/402.15; 222/402.24

[58] Field of Search ..... 222/78, 115, 402.1, 222/402.15, 402.24

[56] References Cited

U.S. PATENT DOCUMENTS

| | | | |
|---|---|---|---|
| 3,353,749 | 10/1965 | Lahaug | 239/154 |
| 4,058,237 | 11/1997 | Luke | 222/78 |
| 4,061,249 | 12/1977 | Smith | 222/78 |
| 4,135,645 | 1/1979 | Kimmell | 222/83 |
| 4,241,850 | 12/1980 | Speer | 222/39 |
| 4,308,976 | 1/1982 | Speer et al. | 222/78 |
| 4,431,118 | 2/1984 | Namdari | 222/39 |
| 4,550,861 | 11/1985 | Fay, Sr. et al. | 222/78 |
| 5,011,044 | 4/1991 | Brown | 222/78 |
| 5,088,624 | 2/1992 | Hackett et al. | 222/78 |
| 5,217,143 | 6/1993 | Aitken | 222/78 |
| 5,316,182 | 5/1994 | Lee et al. | 222/78 |
| 5,358,144 | 10/1994 | Mock | 222/78 |
| 5,678,730 | 10/1997 | Fabek et al. | 222/78 |

OTHER PUBLICATIONS

Product Brochure for Punch!, Aerko International, 3410 N.E. 5th Avenue Ft. Lauderdale, Florida 33334 (no date).

*Primary Examiner*—Kevin Shaver
*Assistant Examiner*—Thach Bui
*Attorney, Agent, or Firm*—Morris, Manning & Martin, LLP

[57] ABSTRACT

The invented apparatus is useful for generating a spray of repellent to ward off an attack by a person or animal. The apparatus includes a canister that contains pressurized repellent such as mace, pepper spray or tear gas. The canister is relatively small, generally four centimeters or less in its largest dimension, so that the canister can be readily concealed. The canister can include a clip that allows the canister to be attached to an article worn or carried by the user. The apparatus can further include a ring that can be worn on a digit of the user's hand, and into which the canister can be inserted. Whether used with or without the ring, the canister can be discharged to ward off an assailant.

33 Claims, 5 Drawing Sheets

ATTACK-DETERRENT APPARATUS HAVING FINGER RING, CANISTER AND REPELLENT

BACKGROUND OF THE INVENTION

1. Field of the Invention

This invention is directed to an anti-assault apparatus that can be carried by a person and used to emit a repellent spray to thwart an attack by a person or animal.

2. Description of the Related Art

Attack deterrent devices of the type that emit a repellent spray have been disclosed for use in personal protection. U.S. Pat. No. 5,088,624 (hereinafter referred to as "the '624 patent") issued Feb. 18, 1992 to Hugh Hackett et al. is an example of such a device. The device includes a housing that contains one or more canisters containing a noxious chemical, an irritant such as mace and/or an indelible dye for later identification of an assailant. Although the canisters afford great flexibility in the type of anti-assault spray that can be used, the housing of the '624 patent's device is relatively large, on the order of seven centimeters or more, and the device is therefore relatively unwieldy to carry on one's person. In addition, because it is rather large and unusual in appearance, the device of the '624 patent can be spotted and possibly disarmed by an assailant before the victim carrying the device has the opportunity to use such device to thwart an attack. It would be desirable to overcome these disadvantages of the prior art.

Finger rings which contain a repellent that can be discharged at an attacker have also been known for use in the field of personal protection. For example, U.S. Pat. No. 3,353,749 (hereinafter referred to as "the '749 patent") issued Oct. 22, 1965 to H. A. Lahaug, U.S. Pat. No. 4,061,249 (hereinafter referred to as "the '249 patent") issued Dec. 6, 1977 to Dale Maxwell Smith, and U.S. Pat. No. 4,135,645 (hereinafter referred to as "the '645 patent") issued Jan. 23, 1979 to Steven D. Kimmell, all disclose rings which contain repellent sprays for discharge at an attacker. These rings are generally advantageous in that they conceal from an assailant the fact that the ring wearer is armed with repellent spray so that such assailant cannot disarm the ring wearer. However, the devices of the '749, '249 and '645 patents all suffer from the disadvantage that their repellent supplies cannot be readily replaced after they are discharged. In addition, with the device of the '645 patent, the user has but one opportunity to disable an attacker because the entire repellent supply is consumed when triggered. In addition to overcoming the above-stated disadvantages, it would be desirable to provide an anti-assault apparatus that affords different options as to how such apparatus can be carried by a person.

SUMMARY OF THE INVENTION

This invention overcomes the above-noted disadvantages. The invented anti-assault apparatus includes a canister for containing a pressurized repellent such as mace, pepper spray or tear gas. The canister can be discharged in a directed spray to deter attack by a person or animal. The canister is relatively small, preferably four centimeters or less in its largest dimension, and thus is readily concealed. Also, the canister can include a clip for removably attaching the canister to an article worn or carried by a person. In addition, the canister can include a valve configured to discharge a limited amount of repellent in each activation of the valve to allow the user several opportunities to disable an attacker.

As an additional option for concealing the canister, the apparatus can include a finger ring to which the canister can be removably fixed. In a preferred configuration, the ring defines a cavity into which the canister can be removably inserted. In one embodiment, the apparatus can include a lever which has an end that engages with the canister's valve and a central portion that contacts a fulcrum defined in the ring, and which can be readily discharged when desired by squeezing an end of the lever toward the ring between two digits of the user's hand. In various embodiments of the canister as disclosed herein, the canister can include various safety mechanisms to prevent accidental discharge of the repellent. In addition, the apparatus can include a spray cap to redirect the repellent spray in a desired direction, and a ball valve that can be used to fill or refill the canister.

These together with other features and advantages, which will become subsequently apparent, reside in the details of construction and operation of the invented apparatus as more fully hereinafter described and claimed, reference being made to the accompanying drawings, forming a part hereof, wherein like numerals refer to like parts throughout the several views.

DESCRIPTION OF THE PREFERRED EMBODIMENTS

Figure 1:
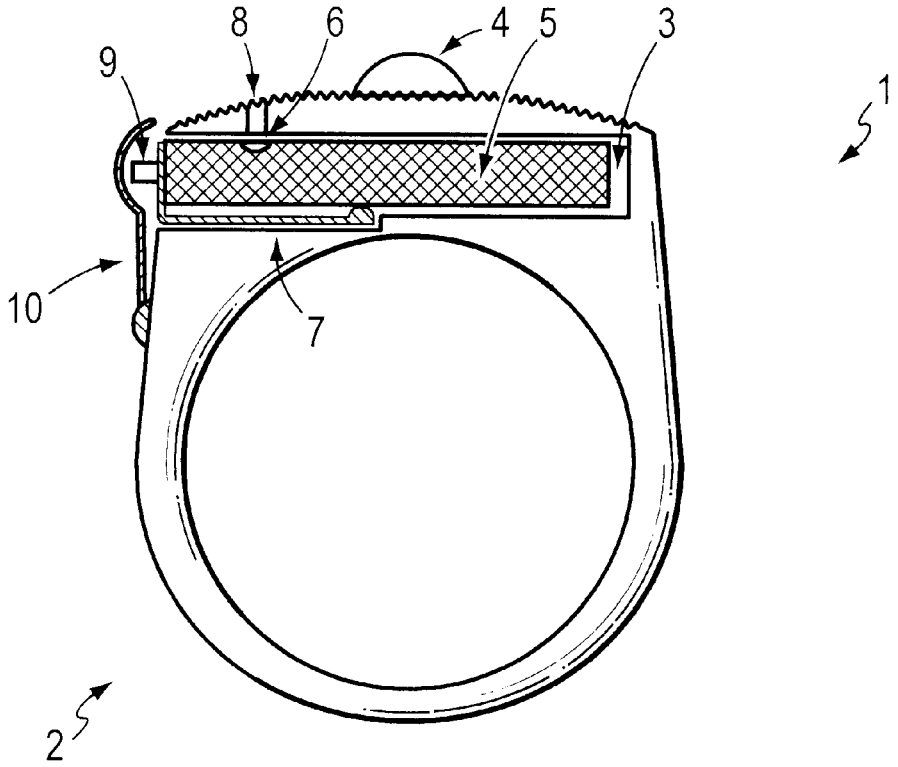
FIG. 1 is a partial cross-sectional view of a first embodiment of an anti-assault apparatus of this invention.

In FIG. 1, a first embodiment of the invented apparatus is generally designated by the numeral '1'. The apparatus 1 includes a ring 2 which defines a cavity 3. The ring 2 is generally made of metal material such as brass, gold, silver, tin, aluminum or other types of metals used in the jewelry industry. Just as with normal cosmetic jewelry, the ring 2 can have an ornament 4 such as a gemstone mounted therein. In addition, the surface of the ring 2 may be provided with design features or relief patterns to further disguise its purpose as an attack deterrent device, in addition to providing the ring with a pleasant appearance.

The apparatus 1 also includes a canister 5 that can be removably inserted into the cavity 3 of the ring 2. Preferably, the cavity 3 is defined in the ring 2 so that the canister 5 fits snugly in the ring 2 and therefore does not tend to slip out when inserted therein. The canister 5 is generally made of a metal such as aluminum or a plastic material, and contains pressurized repellent 100 (not shown in FIG. 1) such as mace, pepper spray or tear gas in liquid or gaseous form, to deter an attacker. In addition to the repellent, the canister can contain a noxious, foul-smelling substance for additional deterrent effect and for identification of the assailant after an assault. Also, in addition to the repellent, the canister 5 can contain a dye to aid in identification and apprehension of an assailant after leaving the scene of an assault. Preferably, such dye is indelible and not apparent to the naked eye in visible light. For example, the dye can be ultraviolet-light-sensitive dye or a dye that is only revealed upon mixing with an additional chemical agent so that the assailant will be unaware that such assailant can be readily identified as the perpetrator of an assault upon exposure to light of the appropriate wavelength or upon treatment of the assailant's skin or clothing with the revealing chemical agent. In its largest dimension, the canister is preferred to be four centimeters or less. In a preferred configuration, the canister is approximately cylindrical in shape, with the largest dimension constituting the length of the canister which extends along its longitudinal symmetric axis. In this preferred configuration, the length of the canister is two-and-a-half centimeters or less and its diameter is one centimeter or less. Preferably, the canister's repellent contents are pressurized to produce a relatively dense spray that travels a distance of at least a few tens of centimeters, and preferably that travels at least one-half meter so that the user can be removed as far as possible from the grasp of the assailant and yet deliver a disabling spray with an outstretched arm to the face of the assailant. It is also preferred that the canister 5 generate a relatively broad spray diameter, for example, of at least ten centimeters wide, at the farthest distance that the spray travels from the canister so that the user's aim can be relatively inexact and yet totally effective in disabling the attacker. Generally, these objectives can be satisfied by pressurizing the canister with repellent 100 at a few tens of pounds per square inch (PSI) (and thus above typical atmospheric pressures at approximately fifteen PSI) to a few hundreds of PSI, and releasing the repellent from the valve with a spray orifice 6 having a diameter of about one millimeter or less. In FIG. 1, the spray orifice 6 is defined in the side of the canister 5. Preferably, the repellent in the canister is pressurized within a range from sixty (60) PSI to onehundred-and-sixty (160) PSI for effective operation at the typical ambient temperatures and pressures likely to be encountered by the user.

The canister 5 is preferred to have a clip 7 that is attached to the outside of the canister. When slid out of the ring 2, the clip 7 can be used to secure the canister 5 to an article worn by the user, such as a shirt pocket, sleeve or belt, for example. The clip 7 can also be used to attach the clip to jewelry or a purse, for example. Alternatively, the canister 5 can be carried loosely in a pants pocket or inside a purse. The canister 5 thus affords great versatility in the manner in which the user can carry the canister. The clip 7 has a configuration and shape similar to clips provided on many commercially-available pens or other writing instruments which are used to secure such writing instruments to a shirt pocket, for example.

For insertion of the canister 5 into the ring 2, the clip 7 can be slid into a groove defined in the ring 2, such groove constituting a portion of the cavity 3. The clip can be fixed to the canister so that the canister has a predetermined orientation when inserted into the ring 2 which aligns the spray orifice 6 with an opening 8 defined in the ring 2. The opening 8 is defined in the ring 2 so that it is at least as wide in diameter as the spray orifice 6 defined in the canister 5 so that the flow of repellent from the canister 5 is not significantly obstructed.

The canister 5 includes a valve 9 that can be operated with a digit(s) of the user's hand to discharge the repellent in a spray. To prevent accidental discharge of repellent spray from the canister, the apparatus of FIG. 1 includes a safety latch 10 which is pivotally mounted to the ring 2. As shown in FIG. 1, the latch 10 can be pivoted into a position to cover the valve 9 so that it cannot be activated inadvertently. When needed to deter an assault, however, the latch can be pivoted to uncover the valve 9 that can be digit-activated to generate a repellent spray. As used herein, 'digit' may refer to either a finger or thumb of a user's hand.

Figure 2:
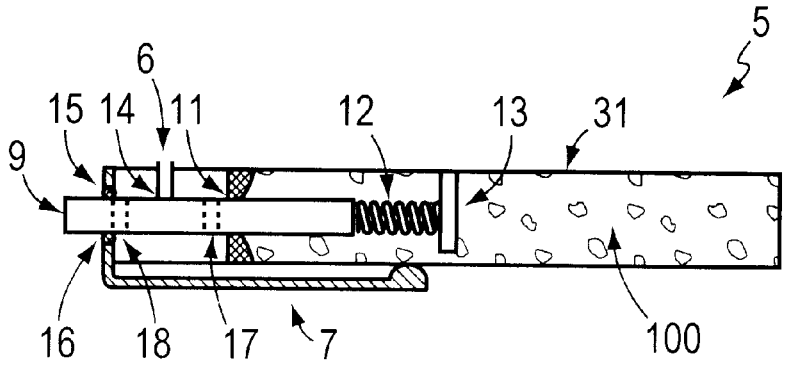
FIG. 2 is a cross-sectional view of a first embodiment of a repellent canister of this invention.

FIG. 2 shows an embodiment of the canister 5 that can be used in the ring 2 of FIG. 1. In FIG. 2, the canister 5 includes a container 31 with an approximately cylindrical wall that contains the pressurized repellent 100. In addition, the canister 5 includes a tapered annular wall 11 that is preferably fixed about its outer edge to the inner wall of the canister, and which defines an opening to slidably receive the valve 9. The end of the valve 9 that is contained within the canister, is attached to one end of a spring 12. The opposite end of the spring 12 is attached to a spring base 13 that is fixed to the inner wall of the canister 5 at a distance spaced to the right in FIG. 2 from the wall 11. An outlet tube 14 has one end extending in a pressure-tight manner through the wall of the container 31 of the canister 5. This end of the outlet tube 14 defines the spray orifice 6. The end of the outlet tube 14 opposite the spray orifice 6, makes close contact with the valve 9 to form a pressure-tight coupling therebetween. The canister 5 can include an end wall 15 which closes the end of the canister 5, and which has an opening through which the valve 9 extends. To provide a pressure-tight coupling between the valve 9 and the end wall 15, an o-ring 16 can be fitted in the end wall 15. The valve 9 defines two apertures 17, 18 that extend transversely through the valve 9 relative to its longitudinal axis of elongation, whose function will be described immediately below.

The spring 12 of FIG. 2 biases the end of the valve 9 to extend outwardly from the canister 5, as shown in FIG. 2. To discharge the canister, the user presses the end of the valve 9 that extends from the canister 5, with a digit of the hand in a direction inwardly toward the canister. This action causes the valve to slide through the end wall 15 and the wall 11, and also compresses the spring 12. As the valve 9 is forced by the user's digit to move to the right in FIG. 2, the aperture 17 moves to a position spanning the innermost edges of the wall 11 at which position pressurized repellent 100 flows from the right side of the wall 11 through the aperture 17 and around the innermost edges of the wall 11 and into the space inside the canister that is to the left side of the wall 11 in FIG. 2. As the valve 9 is pushed further inward toward the canister, the aperture 17 moves past the wall 11 and thus the valve blocks the opening in the wall 11 to prevent any further movement of repellent from the portion of the container 31 to the right of the wall 11 in FIG. 2. Upon further pushing in the valve with the user's digit, the aperture 18 aligns with the outlet tube 14, at which point the pressurized repellent 100 moves from the space inside of the canister that is to the left of the wall 11 through the aperture 18 and the aligned outlet tube 14, and out of the spray orifice 6 in a burst of repellent spray. When the user releases the valve 9, the bias of the valve by the spring 12 forces the valve to move outwardly from the canister to return to the position shown in FIG. 2. The user can repeat the above operations to discharge additional bursts of repellent spray until an attacker is disabled. Therefore, because a limited amount of repellent spray is emitted from the canister 5 in each activation of the valve 9, the user has multiple opportunities to disable an attacker despite the relatively small size of the canister. If the canister is inserted into the ring 2 of FIG. 1 when discharged, the repellent spray travels through an opening 8 defined in the ring 2. Whether used within the ring 2 or removed therefrom, the canister's spray orifice is of course directed toward the eyes and nose of the attacker for best disabling effect.

Figure 3A:
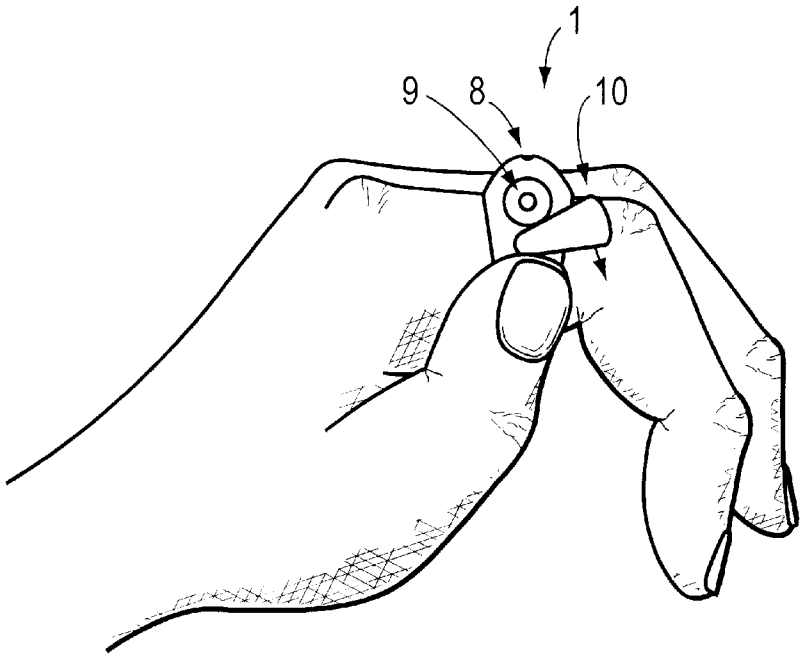
FIGS. 3A and 3B are perspective views of the method of using the anti-assault apparatus of FIG. 1.
Figure 3B:
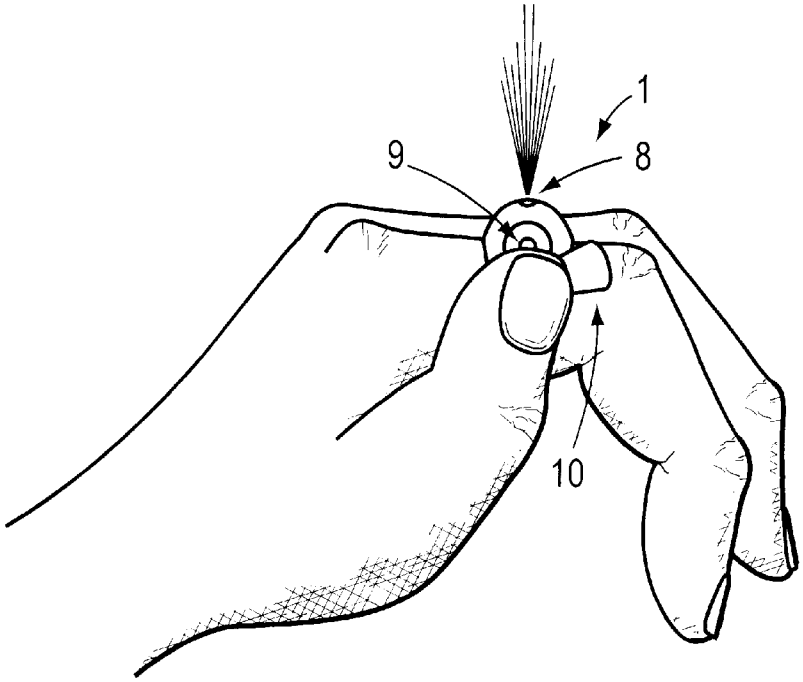

FIGS. 3A and 3B are views of the manner of using the apparatus of FIG. 1. In this case, the user employs a thumb to pivot the safety latch 10 to a position exposing the valve 9, as shown by the direction arrow in FIG. 3A. The user aims the ring opening 8 at the face of an attacker, and, as shown in FIG. 3B, discharges the repellent spray from the apparatus 1 by pressing down the valve 9 with a digit, which in this case is the user's thumb. If the repellent spray misses the attacker, the user can release and press down the valve again to emit another burst of repellent spray at the attacker. The user can repeat the above actions until the attacker is disabled. Preferably, the user operates the valve 9 so as to emit short bursts of repellent spray to afford several opportunities to disable the attacker in spite of the limited amount of repellent contained within the canister 5 which is preferred to be relatively small in size.

Figure 4:
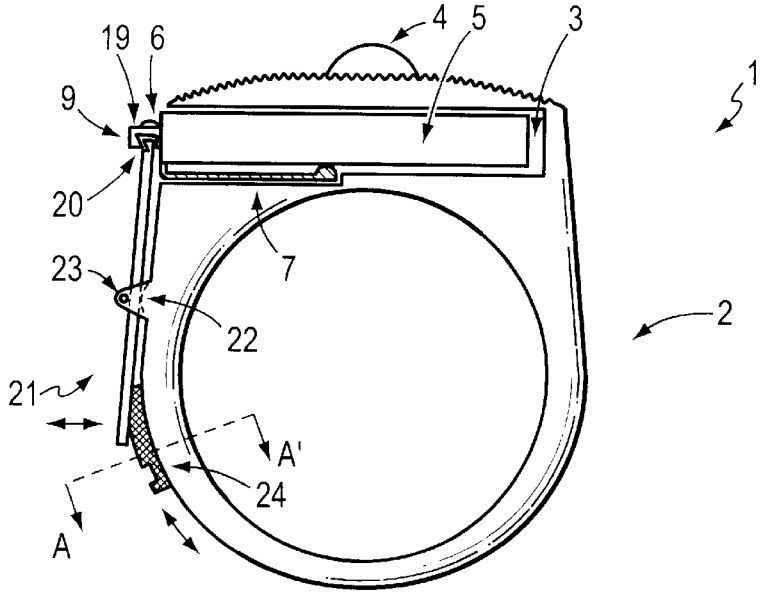
FIG. 4 is a partial cross-sectional view of a second embodiment of an anti-assault apparatus of this invention.

FIG. 4 shows a second embodiment of the apparatus 1, which is similar in many respects to the apparatus FIG. 1. In the apparatus of FIG. 4, however, the valve 9 is configured so that it is spring-biased to be urged in a direction toward the center of the canister, and so that its pressurized repellent is released from the canister upon moving the valve 9 outwardly from the canister against the spring-bias of the valve. Also, in FIG. 4, the valve 9 is configured so that the spray orifice 6 is defined in the portion of the valve that extends outwardly from the canister. In addition, the valve 9 of FIG. 4 has a notch 19 defined therein. The apparatus of FIG. 4 also includes a lever 21 which has a hooked end 20 that is inserted into the notch 19 of the valve 9. The lever 21 is elongated, and has a portion intermediate its two ends, that rests against a fulcrum 22. The lever 21 can be pivoted about the fulcrum 22 to move the valve 9 in a manner to discharge repellent in a spray. The fulcrum 22 is formed as a hump of material protruding from, and preferably integral with, the side of the ring 2. The fulcrum 22 preferably has two opposing surfaces between which the lever is positioned, as denoted by the fact that the lever is indicated in broken line in FIG. 4 in the portion thereof that extends between the two surfaces. The opposing surfaces of the fulcrum 22 can receive a pin 23, an end of which is shown in FIG. 4, that prevents the lever 21 from escaping the fulcrum 22. To prevent accidental discharge of the pressurized repellent 100, the apparatus of FIG. 4 can include a safety slide 24 that is slidably mounted in the outside of the band portion of the ring 2, and which can be slid to a position as shown in FIG. 4 to block movement of the lever 21. The safety slide 24 can also be slid downwardly in FIG. 4 along the outer surface of the ring 2 into a position that is not blocking the lever so that the lever can be pivoted to cause repellent spray to be released from the canister 5.

Figure 5:
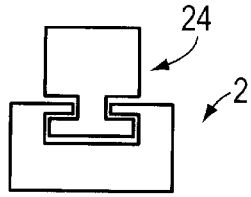
FIG. 5 is a cross-sectional view of the ring and safety slide of FIG. 4.

FIG. 5 shows a cross-sectional view of the safety slide 24 and the ring 22 into which the slide is mounted, taken along the plane A–A' shown in FIG. 4. In FIG. 5, the ring 2 defines a track which receives a T-portion of the safety slide 24. The safety slide 24 is thus retained in the track but yet can be slid in one direction or the other along the outside of the ring 2 to positions that block or free the lever 21.

Figure 6:
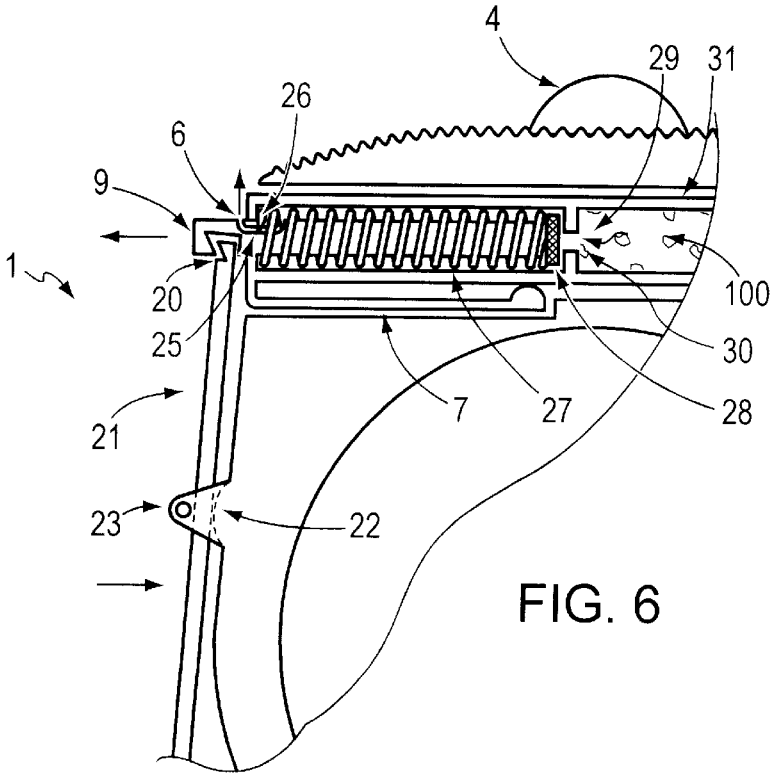
FIG. 6 is a detailed cross-sectional view of the anti-assault apparatus of FIG. 4.

In FIG. 6, a more detailed view of the valve 9 and associated elements of the apparatus of FIG. 4 is shown. In FIG. 6, the valve 9 defines a conduit 25 (shown in broken line) that has one end communicating with the space of the container 31 inside of end wall 26 of the canister 5, and the spray orifice 6 which is positioned exteriorly of the end wall 26. A spring 27 is coiled about the valve 9 and has a first end extending through and closely fitted with the end wall 26 and a second end contacting a stopper 28 which is attached to the end of the valve 9 with a suitable adhesive, for example. The stopper 28 has a larger diameter than that of the valve 9 so that the end of the spring 27 is in contact with the stopper. The spring 27 is thus confined at one end by the wall 26 and at the other end by the stopper 28. The spring 27 urges the stopper 28 against a wall 29 defined in the interior of the canister 5, to close an opening 30 in the wall 29. The opening 30 is defined in the wall 29 so that it has a smaller diameter than that of the stopper 28. The wall 29 partitions the canister 5 into two spaces, one to the left of the wall 29 in FIG. 6 which contains the valve 9, and the other to the right of the wall 29, which contains the pressurized repellent 100. The stopper 28 is preferably made of a plastic or rubber material that forms a pressure-tight seal that withstands the pressure of the repellent 100 to the right of the wall 29 when the stopper 28 is forced against the opening 30 in the wall 28 by the spring 27.

Prior to discharge of the apparatus of FIGS. 4, 5 and 6, the apparatus has a configuration as shown in FIG. 4 in which the safety slide 24 is positioned to block the lever 21 to prevent accidental discharge of the repellent 100. To discharge the apparatus of FIGS. 4, 5, and 6 at an attacker, the safety slide 24 is moved by a digit of the user downwardly in FIG. 4 so that the lever 21 is free to pivot about fulcrum 22. The lower end of the lever 21 in the perspective of FIG. 4 is then pushed by the user's digits toward the side of the ring 2 as shown by the direction arrow in FIG. 6. This action causes the lever to pivot about fulcrum 22 to pull the valve 9 outwardly from the canister 5, as shown by the direction arrow in FIG. 6. As a result of this movement, the stopper 28 moves away from the wall 29 to expose the opening 30. As shown by the direction arrow, pressurized repellent 100 in the right-hand side of the container 31 flows through the opening 30 and into the left hand side of the wall 29, passes through the conduit 26 and out of the orifice 6 in a directed spray. By properly aiming the ring 2 of FIGS. 4, 5 and 6 at the eyes and nose of an attacker, such attacker can be readily disabled. To stop discharge of the device, the lever 21 is released so that the biasing provided by spring 27 forces the valve to move to the right in FIG. 6 so that the stopper 28 contacts the wall 29 and closes the opening 30 to prevent further movement of the repellent from the right-hand side of the wall 29 in FIG. 6. To prevent accidental discharge of the repellent 100 after use of the apparatus of FIGS. 4, 5 and 6, the safety slide 24 can be slid upwardly to a position as shown in FIG. 4 so that it blocks the lever 21.

Figure 7:
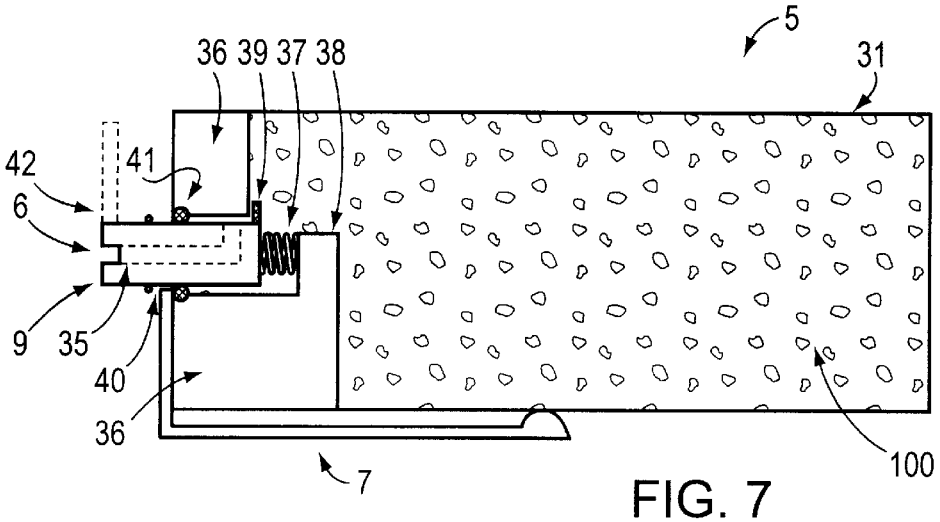
FIG. 7 is a cross-sectional view of a third embodiment of the canister of this invention.

FIG. 7 shows an alternative embodiment of the canister 5, which can be used in the ring of FIG. 1 or by itself as an individual unit. The canister 5 of FIG. 7 has a valve 9 which is differently configured in some respects from those previously described. The valve 9 of FIG. 7 defines an L-shaped conduit 35 which is shown in broken line in FIG. 7. The valve 9 is positioned inside of an opening defined in an end plug 36 which substantially seals the open end of the container 31 of the canister 5. The end of the valve 9 positioned interiorly of the canister 5 contacts one end of a spring 37 whose opposite end contacts a ledge 38. For example, the ledge 38 can be formed integrally with, or can be attached with adhesive to, the plug 36. The spring 37 biases the valve 9 in a direction outwardly from the canister 5 (i.e., toward the left in FIG. 7). To restrict the range of movement of the valve 9, a stop 39 can be attached to the end of the valve 9 that is positioned inside of the canister 5. The stop 39 is made of a rigid material and can be formed integrally with, or attached with an adhesive, for example, to the valve 9. To restrict the degree to which the valve 9 can be pushed into the canister 5, an annular stop 40 can be provided on the end of the valve 9 that extends outwardly from the canister.

The canister 5 of FIG. 7 can also include an o-ring 41 made of plastic or rubber material, for example, to form a pressure-tight fitting between the valve 9 and the plug 36. The canister 5 of FIG. 7 can be inserted into the ring 2 of FIG. 1 and used therein. The canister 5 can also be carried by a person loosely in a pants pocket or purse, for example, or can be clipped with the clip 7 to an article of clothing that the person is wearing. If the user is attacked, the user extracts or unclips the canister 5 and grips it in a hand and aims it at the face of the attacker, or if used in the ring 2, simply aims the ring at the attacker's face. The user directs the spray orifice toward the attacker's face, and pushes the valve 9 into the canister. To make this operation easier, the valve 9 can optionally include a pad 42 to provide a larger surface to accommodate a digit so that the valve 9 can be readily pressed into the canister without the user's digit blocking the spray orifice 6. As the valve 9 is pushed into the canister 5, the end of the conduit 35 clears the edge of the plug 36 and thus communicates with the enclosed space of the container 31 of the canister 5 in which the pressurized repellent 100 is contained. The repellent flows from the container 31 into the conduit 35 of the valve 9 and out of the spray orifice 6 to generate a repellent spray to disable the attacker. To stop the discharge of repellent spray from the canister 5, the user can release digit-pressure on the valve 9 so that the spring 37 urges the valve outwardly from the canister 5 to a position where the conduit 35 is blocked by the plug 36. Preferably, the user operates the valve 9 to release a limited amount of repellent spray in each burst to provide the user with multiple opportunities to disable the attacker despite the preferred relatively small size of the canister 5.

Figure 8:
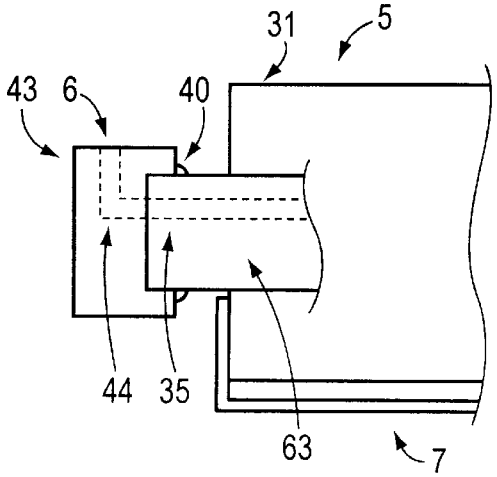
FIG. 8 is a cross-sectional view of a spray cap that can be used in the invented apparatuses.

As an optional feature, the canister 5 of FIG. 7 can include a spray cap 43 as shown in FIG. 8. The spray cap 43 fits over the end of the valve 9 and defines an interior conduit 44 shown in broken line in FIG. 8, that meets with the conduit 35. The spray cap can be pushed onto the end of the valve 9 until it meets with the stop 40. The spray cap 43 can define the conduit 44 in such a manner as to redirect the flow of repellent from the conduit 35 in the valve 9. In the particular example of FIG. 8, the spray cap redirects the flow of repellent from a direction approximately parallel to the longitudinal axis of the canister axis (i.e., the axis along which the canister is elongated), to a direction that is approximately perpendicular to the canister's longitudinal axis. The top of the spray cap can thus be pressed by the user's digit without obstructing the spray orifice 6 to generate a repellent spray that is emitted from the side of the spray cap. Of course, if the spray cap 43 is used on the canister of FIG. 7, the pad 42 would be extraneous and thus is not generally used in this case.

Figure 9:
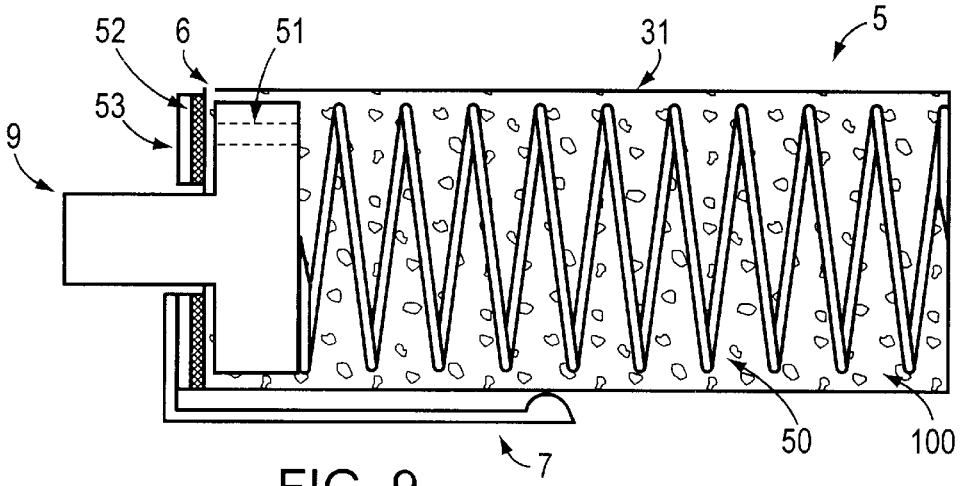
FIG. 9 is a cross-sectional view of a fourth embodiment of the canister of this invention.

FIG. 9 shows another embodiment of the canister 5 in accordance with this invention. In FIG. 9, the canister 5 includes a spring 50 that is fitted inside of the canister. The spring 50 has one end which contacts the right end of the canister in FIG. 9, and another opposite end that contacts the valve 9. In FIG. 9, the valve 9 generally has a disc or cylinder shape with an outer edge that fits tightly to the inner wall of the container 31 to form a pressure-tight seal therebetween. Although not shown in FIG. 8, the outside of the valve 9 can be provided with an o-ring to form a pressure tight seal between the outer surface of the valve 9 and the inner wall of the container 31. The valve 9 also has an end that extends outside of the container 31 through aligned openings in a washer 52 and the end wall 53 of the canister 5 on the left side of FIG. 9. The washer 52 rests against the surface of the end wall 53 that is positioned inside of the container 31, and is generally made of a plastic or rubber material. The spring 50 urges an annular surface of the portion of the valve 9 situated inside of the canister against the washer 52 to close in a pressure-tight manner an aperture 51 defined in the valve 9 (the aperture 51 is shown in broken line in FIG. 9). As so positioned, the valve 9 also blocks the spray orifice 6 that is defined in the canister's side edge in FIG. 9. To operate the canister to ward off an attacker, the canister is gripped in the user's hand or, if the canister has been inserted into the ring 2, the ring is aimed so that the spray orifice 6 and/or opening 8 are directed at the face of the attacker. The user pushes the end of the valve 9 with a digit inwardly toward the canister against the bias of the spring 50. This action causes the portion of the valve 9 inside of the canister to move away from the washer 52 so that the conduit 51 has one end communicating with the interior space of the container 31 which contains the pressurized repellent 100, and the other end of the conduit 51 communicates with the space that would then exist between the washer 52 and the valve 9. Pressurized repellent 100 thus flows from the left hand side of the valve 9 through the conduit 51 to the space between the washer 52 and the valve 9 and outwardly from the orifice 6 in a spray. After disabling the attacker, the user can release digit pressure on the valve 9 which is then forced by spring 50 to the left in FIG. 9 against the washer 52 to close off the conduit 51 and the spray orifice 6 to stop the flow of repellent 100 out of the container 31.

Figure 10:
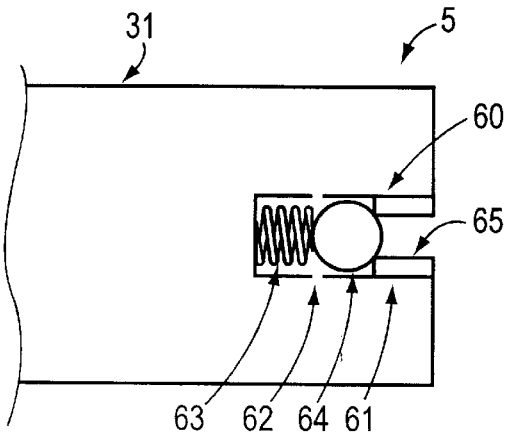
FIG. 10 is a cross-sectional view of a ball valve that can be used for filling or refilling the invented canisters.

As shown in FIG. 10, any of the embodiments of the canister 5 disclosed herein can be provided with a ball valve 60 for filling or refilling the canister with pressurized repellent 100. The ball valve 60 includes a valve container 61 that extends into the container 31 of the canister 5, and that defines openings 62 that provide communication between the space inside of the valve container 61 and the space for storage of repellent 100 inside of the container 31. The valve container 61 holds a spring 63 that has one end that abuts a closed end of the valve container 61, and a second end that contacts a ball 64. A tube 65 is fitted inside of the valve container 61, and has an inner diameter that is less than that of the ball 64. The spring 63 urges the ball 62 against the end of the tube 65 so that the ball valve seals off the interior of the canister from the atmosphere outside of the canister. However, to fill or refill the canister 5, a nozzle (not shown) that is coupled to communicate with a pressurized supply of repellent, can be inserted into the tube 65 to an extent sufficient to push the ball 64 away from the end of the tube 65. The nozzle preferably closely fits the inner diameter of the tube 65 and has orifices on its outer side edges near its tip or notches that extend from the tip along the side of the nozzle for a short distance so that repellent can flow from the pressurized repellent supply through the nozzle orifices or notches and through the openings 62 into containment inside of the canister's container 31. Upon retracting the nozzle from the ball valve 60, the ball 64 is urged by spring 63 against the end of the tube 65 to block the escape of repellent from the canister 5.

As an alternative to the ball valve, the canisters 5 disclosed herein can be filled by opening the valve 9 to allow communication between the spray orifice 6 and the interior of the canister's container 31. A nozzle coupled in communication with a pressurized source of repellent can be inserted into the spray orifice to fill the canister 5. After the canister 5 is filled or refilled with repellent, the valve 9 is allowed to close to prevent the escape of the repellent until needed to ward off an attacker. The nozzle is then retracted from the spray orifice 6.

Figure 11:
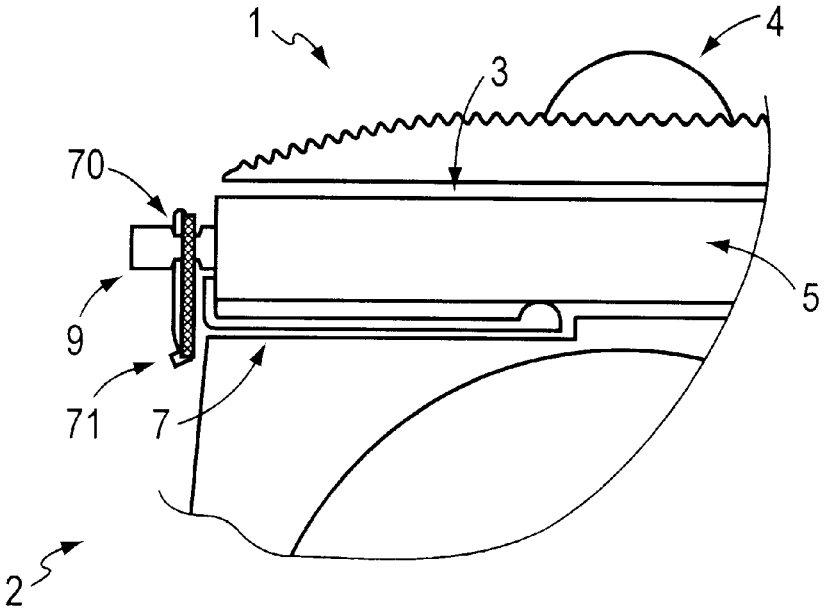
FIG. 11 is a partial cross-sectional view of an apparatus of this invention showing a first embodiment of a safety catch.
Figure 12:
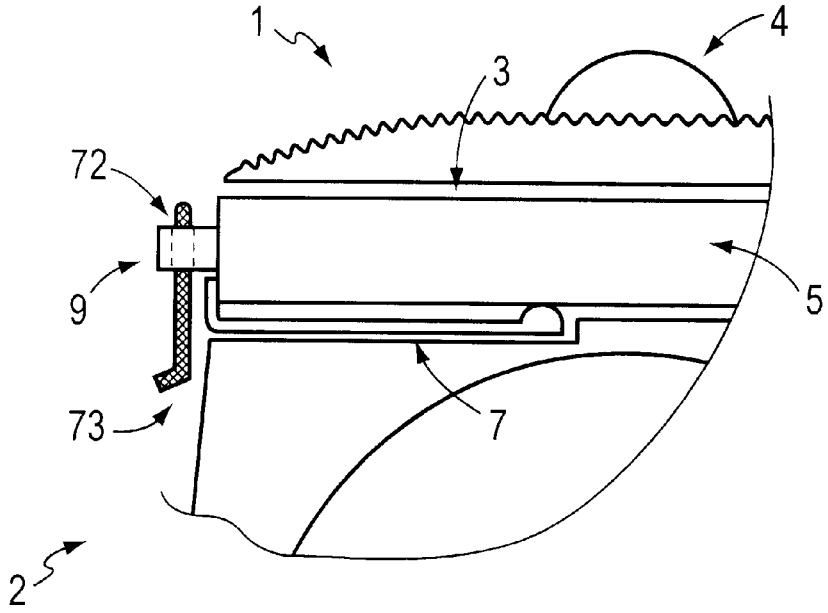
FIG. 12 is a partial cross-sectional view of an apparatus of this invention showing a second embodiment of the safety catch.

FIGS. 11 and 12 show two additional safety mechanisms for preventing accidental discharge of the repellent 100 from the canister 5. The safety mechanism of FIG. 11 can be used with any of the canister embodiments in which the valve 9 is pressed inwardly toward the canister to release the repellent, which includes the canisters of FIGS. 1, 7 and 9. To use the mechanism of FIG. 11, the valve 9 is provided with an annular groove 70 which encircles the portion of the valve 9 that extends from the canister 5. The safety mechanism of FIG. 11 is a v- or un-shaped safety catch 71 that is fitted into the annular groove 70 to prevent movement of the valve 9. To discharge the canister, the safety catch 71 is first pulled away from the valve 9 before depressing the valve to discharge the repellent spray. The safety catch 71 has a protruding surface at its extreme lower end in FIG. 11 to allow the user a fingerhold to pull the safety catch from the valve. In FIG. 12, the portion of the valve 9 that extends from the canister 5 defines an aperture 72 extending therethrough. The safety mechanism of FIG. 12 is a safety catch 73 that has an elongated pin-like configuration that prevents movement of the valve 9 when inserted therethrough. To discharge the repellent in the canister, the safety catch 73 is first pulled away from the valve 9 to allow the valve to be pushed inwardly toward the canister to discharge the repellent spray. The safety catch 73 has a protruding surface at its extreme lower end in FIG. 12 to allow the user a fingerhold to assist in removing the safety catch from the valve.

Unless stated specifically to the contrary herein, the elements of the various embodiments of the anti-assault apparatus described in this document, including the invented canisters, can be made from molded, extruded, stamped or machined plastic or metal materials. In addition, it should be appreciated that the canisters 5 can be either refillable or disposable. Furthermore, the canister 5 inserted into the ring 2 can be readily replaced with another canister to ensure that a fresh supply of repellent is available for use if needed to ward off an attacker. In addition, the canisters 5 can be filled with different types of repellents, noxious chemicals, dyes or even sickness-inducing chemicals that can be selected as desired according to the situation that the apparatus' user expects to encounter as well as restrictions on the use of such substances as may be imposed by law.

Although the canister 5 is generally preferred to be cylindrical in shape, the canister could be made in other shapes. For example, rather than having a cylindrical shape with a circular cross-section as viewed in a plane perpendicular to the longitudinal symmetric axis of the canister, the canister could have an oval cross-section, or a cross-section with two opposing parallel planes joined together at their respective ends by two opposing semi-circular or rounded surfaces. Alternatively, the canister's cross-section could be square, rectangular or trapezoidal, for example. Of course, the cavity 3 defined in the ring 2 preferably has a shape conforming closely to that of the canister.

Although the ring 2 as described and illustrated herein defines a cavity 3 to receive the canister 5, the canister can be removably fixed to the ring in other ways. For example, rather than defining the cavity 3, the ring 2 can be configured to define a track to receive the canister's clip with the remainder of the canister being exposed above the ring. Alternatively, clasps or buckles can be fixed to either the ring or canister to encircle and hold the canister 5 to the ring when closed, but which can be opened to allow extraction of the canister from the ring.

The many features and advantages of the present invention are apparent from the detailed specification and thus, it is intended by the appended claims to cover all such features and advantages of the described apparatus which follow in the true spirit and scope of the invention. Further, since numerous modifications and changes will readily occur to those of ordinary skill in the art, it is not desired to limit the invention to the exact construction and operation illustrated and described. Accordingly, all suitable modifications and equivalents may be resorted to as falling within the spirit and scope of the invention.

What is claimed is:

1. An apparatus for wear on a digit of a user's hand, the apparatus comprising:

a finger ring composed of a single piece of material defining a cavity having an opening;

a repellent; and a canister capable of being inserted into the cavity through the opening in the ring to removably fix the canister in the ring, the canister for containing the repellent under pressure, the canister having a valve fitted to the canister, the valve protruding outwardly from the opening of the ring, the valve operable by at least one digit of the user's hand to release the pressurized repellent from the canister in a directed spray, the canister capable of being extracted from the cavity through the opening of the ring to replace or refill the canister.

2. An apparatus as claimed in claim 1, wherein the ring defines a cavity that conforms to the shape of the canister, and wherein the canister is removably fixed to the ring by insertion into the cavity defined therein.

3. An apparatus comprising:

a finger ring;

a repellent; and a canister capable of being removably fixed to the ring, the canister for containing the repellent under pressure, the canister having a valve fitted to the canister, the valve operable to release the pressurized repellent from the canister in a directed spray;

the ring defining a cavity that conforms to the shape of the canister, and the canister removably fixed to the ring by insertion into the cavity defined therein, and a clip mounted to the canister, the clip sliding into a groove defined in the ring when the canister is inserted into the ring, the clip for securing the canister to an article worn or carried by a person when the canister is removed from the ring.

4. An apparatus comprising:

a finger ring;

a repellent; and a canister capable of being removably fixed to the ring, the canister for containing the repellent under pressure, the canister having a valve fitted to the canister, the valve operable to release the pressurized repellent from the canister in a directed spray;

the ring defining a cavity that conforms to the shape of the canister, and the canister removably fixed to the ring by insertion into the cavity defined therein, a safety latch pivoted to the ring, the safety latch movable to a first position in which the latch covers the valve, and the safety latch movable to a second position in which the valve is exposed for activation.

5. An apparatus as claimed in claim 1, further comprising:

a clip mounted to the canister, the clip for securing the canister to an article worn or carried by a person when the canister is removed from the ring.

6. An apparatus as claimed in claim 1, wherein the repellent includes pepper spray.

7. An apparatus as claimed in claim 1, wherein the repellent includes mace.

8. An apparatus as claimed in claim 1, wherein the repellent includes tear gas.

9. An apparatus as claimed in claim 1, wherein the largest dimension of the canister is four centimeters or less.

10. An apparatus as claimed in claim 1, wherein the canister is approximately cylindrical with a diameter of one centimeter or less and a length of three centimeters or less.

11. An apparatus as claimed in claim 1, wherein the canister is disposable.

12. An apparatus as claimed in claim 1, wherein the valve is digit-activated.

13. An apparatus as claimed in claim 1, further comprising:

a lever engaging with the valve and contacting a fulcrum defined on the ring, the lever operable by digit to pivot about the fulcrum so that the valve is moved to a position to release pressurized repellent from the canister.

14. An apparatus comprising:

a finger ring;

a repellent; and a canister capable of being removably fixed to the ring, the canister for containing the repellent under pressure, the canister having a valve fitted to the canister, the valve operable to release the pressurized repellent from the canister in a directed spray;

a lever engaging with the valve and contacting a fulcrum defined on the ring, the lever operable by digit to pivot about the fulcrum so that the valve is moved to a position to release pressurized repellent from the canister; and a safety slide slidably mounted to the ring, the safety slide movable to a first position to block movement of the lever to prevent accidental discharge of the repellent from the canister, and the safety slide movable to a second position where the slide does not block the lever so that the lever can be digit-activated to release a spray of repellent from the canister.

15. An apparatus as claimed in claim 1, further comprising:

a safety catch coupled to the end of the valve, the safety catch abutting against the ring to prevent movement of the valve when the safety catch is coupled to the valve, the safety catch being digit-removable from the valve to allow the valve to be activated to release pressurized repellent.

16. An apparatus as claimed in claim 1, further comprising:

a spray cap coupled to the valve, for directing the repellent spray in a predetermined direction.

17. An apparatus as claimed in claim 1, further comprising:

a ball valve extending into the canister, for filling the canister with pressurized repellent.

18. An anti-assault apparatus operable by at least one digit of a person, the apparatus comprising:

a canister including a container for containing a pressurized repellent;

a wall positioned in the container to partition first and second spaces therein, the wall defining an opening;

a valve having an elongated shape and defining first and second openings that extend transversely to a longitudinal axis of the valve, the valve extending through the opening in the wall, a first end of the valve extending through an opening in the end of the container;

a spring base positioned in the container in the second space;

a spring coupled between the spring base and a second end of the valve; and an outlet tube extending through the canister and having a first end contacting the valve, and a second end extending from the canister, the spring forcing the valve to move to a position blocking the outlet tube when the valve is released, the valve being operable by digit to move the valve into the canister so that the valve's first opening spans the wall to allow pressurized repellent to flow from the first space into the second space to fill the second space with a predetermined amount of repellent, the spring compressing as the valve is pushed inwardly into the canister, and as the valve is further pushed into the canister, the second opening in the valve aligning with the outlet tube to release the pressurized repellent present in the second space from the canister in a spray, and the valve forced by the spring to return to a position blocking the outlet tube when digit pressure on the valve is released.

19. An apparatus as claimed in claim 18, further comprising:

a clip attached to the canister, for removably attaching the canister to an article worn or carried by the person.

20. An apparatus as claimed in claim 18, wherein a largest dimension of the canister is four centimeters or less.

21. An apparatus as claimed in claim 18, wherein the canister is approximately cylindrical with a diameter of one centimeter or less and a length of three centimeters or less.

22. An apparatus as claimed in claim 18, further comprising:

a ball valve extending into the canister, for filling the canister with pressurized repellent.

23. An anti-assault apparatus operable by at least one digit of a person, the apparatus comprising:

a canister including a container for containing a pressurized repellent;

a valve defining a conduit, and defining a stop;

a plug situated in an open end of the container to contain the pressurized repellent, the plug defining an opening in which the valve is situated, the plug further defining a ledge;

a spring coupled between an end of the valve and the ledge; and an O-ring situated in the opening of the plug and surrounding the valve, the valve stop restricting the movement of the valve under bias by the spring, the valve's conduit being blocked by the plug when the valve is released, the valve being movable by pressing the valve toward the canister with a digit so that the spring compresses and the conduit defined in the valve communicates with the space enclosed by the container to cause the pressurized repellent to flow through the conduit and out of the canister in a directed spray.

24. An apparatus as claimed in claim 23, further comprising:

a ball valve extending into the canister, for filling the canister with pressurized repellent.

25. An apparatus as claimed in claim 23, further comprising:

a spray cap coupled to the valve, for directing the repellent spray in a predetermined direction.

26. An anti-assault apparatus operable by at least one digit of a person, the apparatus comprising:

a canister including a container for containing a pressurized repellent;

an end wall closing an open end of the container;

a washer situated in contact with the canister's end wall;

a valve having a digit-activatable portion extending through openings in the end wall and washer, and a cylinder portion that defines an aperture, the cylinder portion having an outer portion that fits closely with the inner surface of the container;

a spring positioned in the canister and having a first end contacting a closed end of the container and a second end contacting the valve, the spring biasing the valve against the washer to close the aperture, the digit-activatable portion of the valve being movable by digit to cause the valve to move into the container and away from the washer so that the valve's aperture is unobstructed to allow pressurized repellent to flow from the container through the valve's aperture and out of an opening defined in the side of the canister in a directed spray.

27. An apparatus as claimed in claim 26, further comprising:

a ball valve extending into the canister, for filling the canister with pressurized repellent.

28. An apparatus as claimed in claim 26, further comprising:

a spray cap coupled to the valve, for directing the repellent spray in a predetermined direction.

29. An apparatus comprising:

a canister including a container for containing a pressurized repellent;

a wall situated in the container to partition the container into first and second spaces, the wall having an opening;

a valve having a stopper with a larger diameter than the valve, the valve extending through an opening in the end of the container and positioned so that the stopper opposes the wall; and a spring coiled about the valve, and having a first end contacting the stopper and a second end contacting the end of the container through which the valve extends, the spring biasing the stopper against the wall to close the opening in the wall, the valve defining a conduit extending from the first space to the exterior of the canister, the valve being movable so that the stopper unblocks the opening in the wall to release pressurized repellent from the second space into the first space where the repellent passes through the valve's conduit and out of the valve in a directed spray.

30. An apparatus as claimed in claim 29, further comprising:

a ring defining a cavity that receives the canister, the ring further defining a fulcrum on a side portion thereof; and an elongated lever having an end fitted in a notch defined in the valve, and having a central portion contacting the fulcrum, the lever being operable to move the valve so as to produce the spray of repellent.

31. An apparatus as claimed in claim 30, further comprising:

a slide safety slidably mounted to the ring, the slide safety being moveable to a first position blocking the lever's movement to prevent accidental discharge of the repellent, and the slide safety being movable to a second position in which the lever can be moved to produce the spray of repellent.

32. An apparatus as claimed in claim 29, further comprising:

a ball valve extending into the canister, for filling the canister with pressurized repellent.

33. An apparatus as claimed in claim 29, further comprising:

a spray cap coupled to the valve, for directing the repellent spray in a predetermined direction.

* * * * *